US005619751A

United States Patent [19]

Ray et al.

[11] Patent Number: 5,619,751

[45] Date of Patent: Apr. 15, 1997

[54] SAFETY VEST AND METHOD FOR USE IN WATER AND OTHER APPLICATIONS

[75] Inventors: Eric Ray, Riverside, Calif.; Todd Schmidt, 2957 Oakbrook Dr., Riverside, Calif. 92503

[73] Assignee: Todd Schmidt, Riverside, Calif.

[21] Appl. No.: 404,901

[22] Filed: Mar. 14, 1995

Related U.S. Application Data

[63] Continuation-in-part of Ser. No. 219,193, Mar. 28, 1994, abandoned.

[51] Int. Cl.[6] ..... A41D 1/04

[52] U.S. Cl. ..... 2/102; 2/69

[58] Field of Search ..... 2/102, 338, 311, 2/312, 318, 336, 108, 69, 69.5, 94, 321; 441/80, 106, 108; 224/157, 158; 54/37.1, 44.1, 46, 47, 49; D3/31, 27, 28; 297/464, 465, 467, 468; 128/869, 870, 873, 875, 876, 134; 119/846, 96

[56] References Cited

U.S. PATENT DOCUMENTS

| | | | |
|---|---|---|---|
| 2,563,766 | 8/1951 | Weinstein et al. | 119/96 |
| 2,956,541 | 10/1960 | Rall | 54/44.1 |
| 3,487,474 | 1/1970 | De Meo | 2/338 |
| 3,533,107 | 10/1970 | Raneri et al. | 2/93 |
| 3,562,812 | 2/1971 | Greggains | 2/94 |
| 4,172,292 | 10/1979 | Horton | 2/102 |
| 4,396,013 | 8/1983 | Hsslinger | 128/134 |
| 4,625,334 | 12/1986 | Proffer | 2/102 |
| 4,936,805 | 6/1990 | Piatt, Jr. | 441/108 |
| 5,152,013 | 10/1992 | Johnson | 2/338 |
| 5,361,418 | 11/1994 | Luzenske | 2/312 |

*Primary Examiner*—C. D. Crowder
*Assistant Examiner*—Gloria Hale
*Attorney, Agent, or Firm*—John J. Connors; Connors & Assoc.

[57] ABSTRACT

A marine vest 10 designed to be worn by an operator of a personal watercraft while wearing a life jacket. The vest 10 includes a back section comprising a pair of shoulder straps positioned to fit over the shoulders of the operator. The straps are attached to a waist section which wraps around the operator's waist. This waist section has free ends which terminate near the middle of the front upper torso of the operator. Each free end has attached to it one component of a two-component buckle, so that the operator can manually buckle and unbuckle the two-component buckle while the vest is being worn. A pair of handles are attached to the waist section, each handle at one side of the operator. A second rider immediately seated behind the operator can thus grasp firmly these handles and more securely maintain his or her seated position on the watercraft. The vest 10 being sized to fit over the life jacket and is made of buoyant materials so that it will float in water.

7 Claims, 3 Drawing Sheets

SAFETY VEST AND METHOD FOR USE IN WATER AND OTHER APPLICATIONS

RELATED PATENT APPLICATION

This application is a continuation-in-part application of application U.S. Ser. No. 08/219,193, entitled "MARINE VEST WITH HAND GRIPS AND METHOD," filed Mar. 28, 1994 now abandoned. This related copending application is incorporated herein by reference and made a part of this application.

BACKGROUND OF THE INVENTION

1. Field of the Invention

This invention relates to a safety vest that allows the rear rider of a pair of tandem riders to hold onto the forward rider. In particular, the safety vest is worn over a life jacket by a person operating a personal watercraft. There are hand grips or handles on the sides of the vest which enable a rider seated behind the operator of a watercraft, or other vehicle, to hold on to the operator by means of the handles.

2. Background Discussion

The use of personal watercraft such as, for example, the Jet Ski® is very popular. These personal watercraft are designed to hold one or more persons. For example, when two people are riding on the watercraft, the rider sits close behind the watercraft's operator and wraps his or her arms around the operator's waist. Because it is mandatory for safety reason that the operator wear a life jacket, the rider frequently has difficulty maintaining a firm grasp of the operator. This is especially true when children are riders, because their arms are so short. These watercraft can reach speeds of over 40 miles per hour and, if the rider looses his or her grip and falls off the watercraft, the rider can be seriously injured.

SUMMARY OF THE INVENTION

It is the objective of this invention to provide a safety vest that allows the rear rider of a pair of tandem vehicle riders to grasp the forward rider who wears the safety vest. It is another objective of this invention to provide a marine vest which can be worn over a life jacket by the operator of the watercraft and has handles that allow a second rider to grasp firmly these handles and more securely maintain his or her seated position on the watercraft.

The vest of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its advantages, which include ease of construction, enhanced safety, and simplicity of use.

The first feature of the marine vest of this invention is that it is sized to fit over a life jacket worn by a person on a personal watercraft. The vest is primarily made of buoyant and non-water absorbing materials so that it will float in water.

A waist section wraps around the person's waist while the life jacket is being worn, which has free ends which terminate near the middle of the front upper torso of said person while the vest is being worn. Each free end has attached thereto one component of a two-component fastener, so that the person can manually fasten and unfasten the two-component fastener while the vest is being worn. There are a pair of handles attached to the waist section. Each handle is at one side of the person while the vest is worn. Any conventional fastener may be used such as, for example, a buckle or hook and fabric connector such as sold under the trademark Velcro®. The waist section preferably includes a strap with an adjustable length to accommodate persons having different size waists.

The second feature is that the vest includes a back section comprising a pair of shoulder straps positioned to fit over the shoulders of the operator while wearing the life jacket. The straps are attached to the waist section. In the preferred embodiment of this invention, each shoulder strap has a front segment and a back segment extending lengthwise towards the waist of the person, respectively, over the life jacket's front and back while the vest is being worn. Each segment has terminal ends near the waist of the person while the vest is being worn. Preferably, there is a webbing material connected between the back segments of the shoulder straps.

The third feature is that waist section may include a cross strap and a waist strap. The cross strap is attached to an intermediate portion of each of the front and back segments of the shoulder straps and is positioned to be underneath and nearby the arm pits of the person while the vest is being worn. The cross strap has free ends which terminate near the middle of the front upper torso of the person while the vest is being worn. Each free end has attached to it one component of a first two-component buckle, so that the person can manually buckle and unbuckle the first two-component buckle while the vest is being worn. The waist strap is positioned below and spaced from the cross strap and is attached to the terminal ends of the front and back sections of the shoulder straps. The waist strap has free ends which terminate near the middle of the front upper torso near the waist of the operator while the vest is being worn. Each free end has attached to it one component of a second two-component buckle, so that the person can manually buckle and unbuckle the second two-component buckle while the vest is being worn.

The fourth feature is a pair of handles attached to the waist section. Each handle is at one side of the person while the vest is worn. Preferably, each handle comprises a tubular foam member with a connecting strap passing through the member. The connecting strap is attached to the waist section, preferably across the cross strap and waist strap.

This invention also includes a method for two people to ride a personal watercraft, each being on the same seat of the water craft, with one person being forward on the seat and a rider being on the seat immediately behind the person. This method includes (a) the person wearing over a life jacket a marine vest including a waist section which wraps around the person's waist while the life jacket is being worn, said waist section having free ends which terminate near the middle of the front upper torso of said person while the vest is being worn, each free end having attached thereto one component of a two-component fastener, so that said person can manually fasten and unfasten the two-component fastener while the vest is being worn, and a pair of handles attached to the waist section, each handle being at one side of said person while the vest is worn, said vest being sized to fit over said life jacket being buoyant so that it will float in water, and (b) the rider grasping the handles firmly while seated behind the person.

DESCRIPTION OF THE DRAWING

The preferred embodiment of this invention, illustrating all its features, will now be discussed in detail. This embodiment depicts the novel and non-obvious method and device of this invention shown in the accompanying drawing, which is for illustrative purposes only. This drawing includes the following figures (Figs.), with like numerals indicating like parts.

DESCRIPTION OF THE PREFERRED EMBODIMENT

Figure 1:
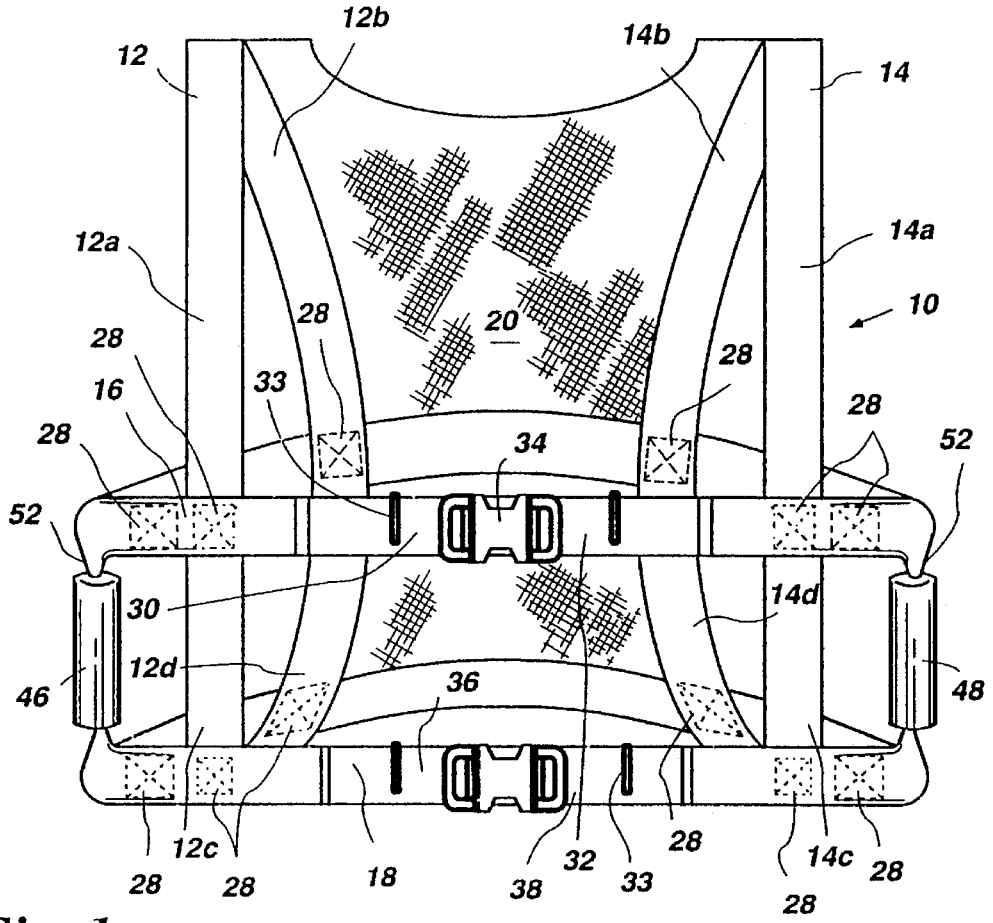
FIG. 1 is a front elevational view of the marine vest of this invention.
Figure 2A:
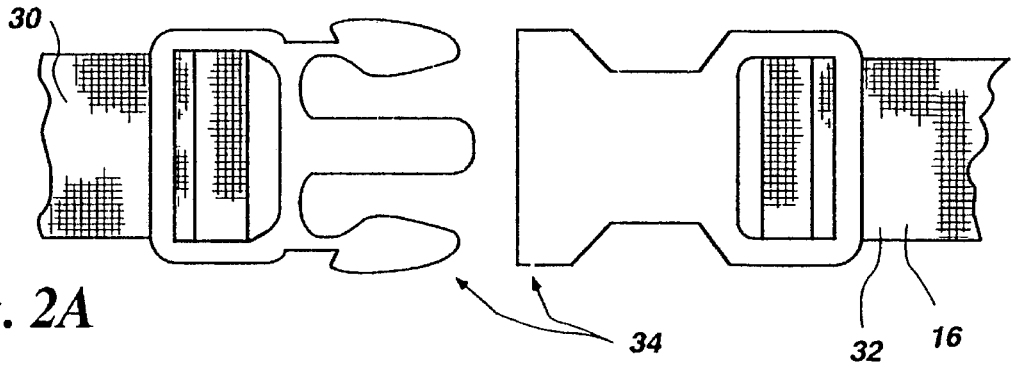
FIG. 2A is a fragmentary front view of an unfastened buckle attached to the ends of a strap of the vest shown in FIG. 1.
Figure 2B:
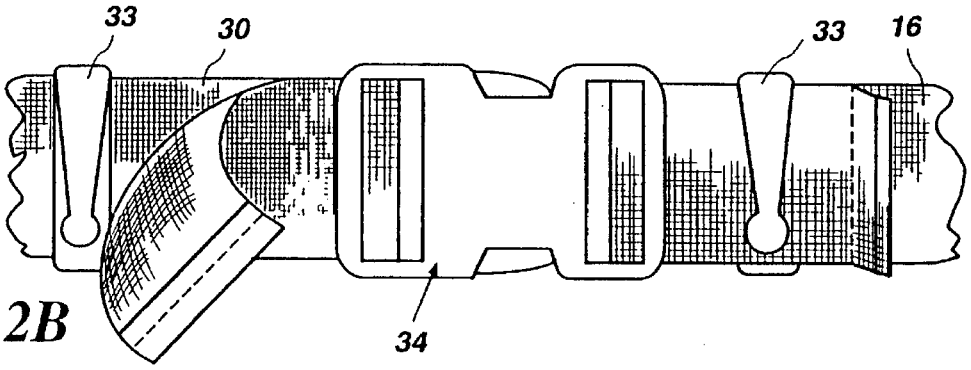
FIG. 2B is a fragmentary front view of the buckle shown in FIG. 2A fastened and adjusted to fit the waist of the user.
Figure 5:
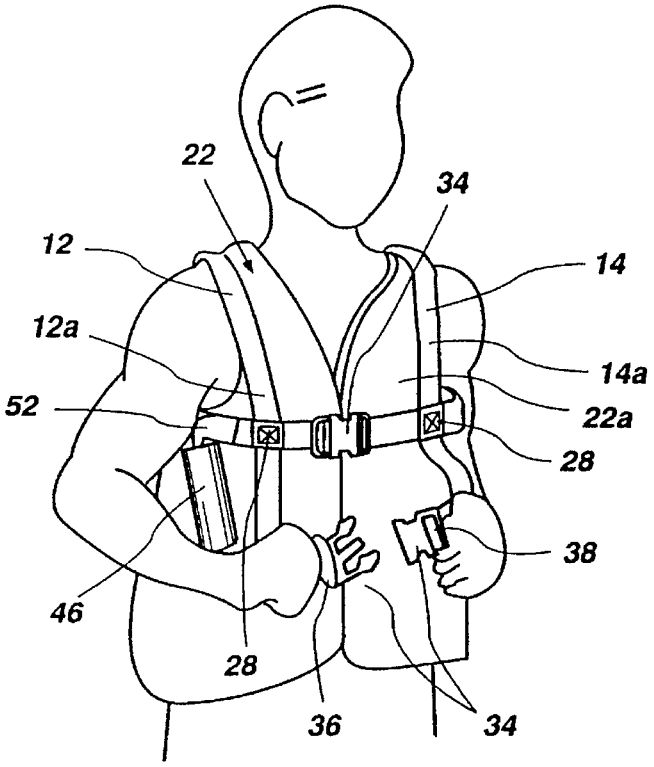
FIG. 5 is a perspective view showing the front of the vest as it is being put on over a life jacket by the operator.
Figure 6:
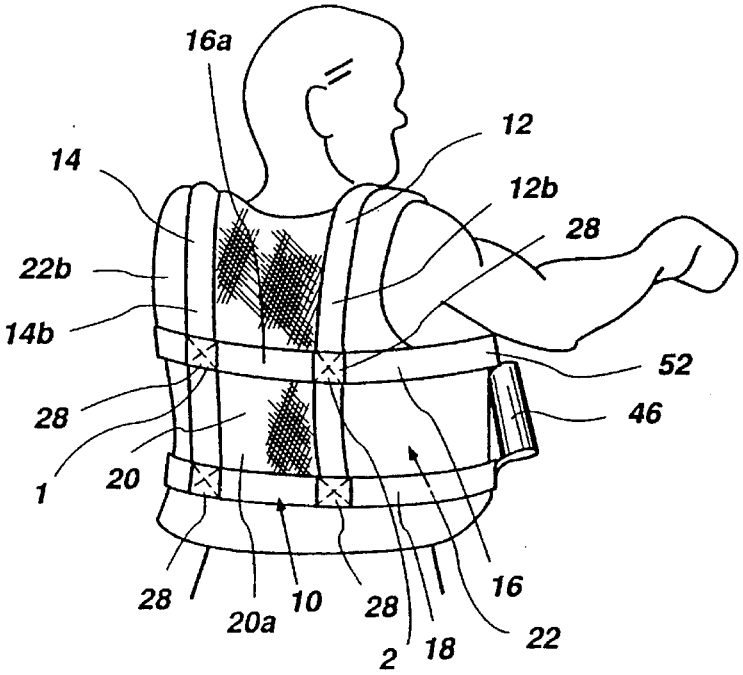
FIG. 6 is a perspective view showing the back section of the vest of this invention after being placed on the operator who is wearing a life jacket.

As best shown in FIGS. 1, 5, and 6, the marine vest 10 of this invention comprises four straps; a pair of shoulder straps 12 and 14, a cross strap 16, and a waist strap 18. Each shoulder strap 12 and 14 has front segments 12*a* and 14*a*, respectively, and back segments 12*b* and 14*b*, respectively, which are positioned, respectively, over the front 22*a* and back 22*b* of a life jacket 22 worn by an operator 24 of a personal watercraft 26. There is a webbing material 20 connected between back segments 12*b* and 14*b* of the shoulder straps 12 and 14. This is accomplished by sewing the webbing material 20 along a seam (not shown) to the back segments 12*b* and 14*b*. The lower portion 20*a* of the webbing material 20 is sewn along a seam (not shown) to the central back portion 18*a* (FIG. 6) of the waist strap 18. Thus, the webbing material 20 keeps the shoulder straps 12 and 14 in position so they do not become entangled, enabling a person to quickly and conveniently put on the marine vest 10. A central back portion 16*a* (FIG. 6) of the cross strap 16 only has its opposed ends 1 and 2 connected to the webbing material 20. Consequently, the central back portion 16*a* is free and serves as a handle, allowing a person the grasp it when desired.

The cross strap 16 is immediately below the arms of the operator 24 when the vest 10 is being worn as shown in FIGS. 5 and 6. This cross strap 16 is attached to intermediate portions of both the front and back segments 12*a*, 12*b*, 14*a*, and 14*b* of the shoulder straps 12 and 14. The cross strap 16 terminates in two free terminal ends 30 and 32. Each free end 30 and 32 has one component of a two component buckle 34 attached to it.

The shoulder straps 12 and 14 each have terminal ends 12*c*, 12*d* and 14*c*, 14*d*, respectively, which are connected to the waist strap 18. Conventional box stitches 28 are used to attach both the cross strap 16 and waist strap 18 to the front and back segments of the shoulder straps 12 and 14. The waist strap 18 also has free terminal ends 36 and 38, with one component of another two component buckle 34 attached to each of these free terminal ends. There is extra length in both the waist strap 18 and cross strap 16 to allow for adjustments to accommodate people of different sizes. The extra lengths of these straps 16 are held in position by clips 33.

The buckles 34 are preferably of the type that allows each of the free ends 30 and 32 of the cross strap 16 and each of the free ends 36 and 38 of the waist strap 18 to be independently adjusted. This dual adjustability allows the vest 10 the fit many different sized users. The buckles 34 may be adjusted so that they are centered in font of the users' torso. A suitable buckle 34 may be obtained from National Molding of Farmingdale, N.Y.

Figure 4:
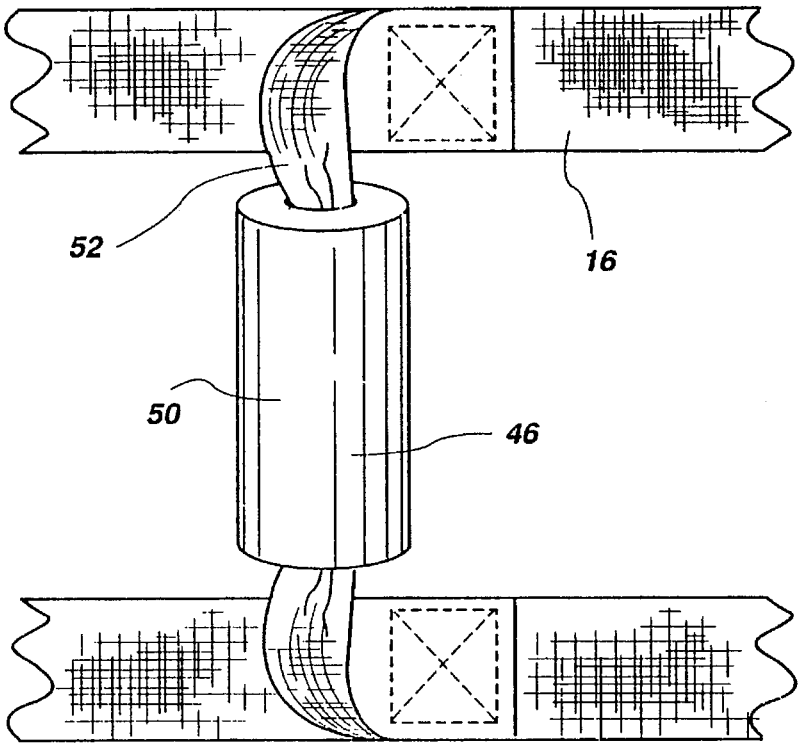
FIG. 4 is a fragmentary side view showing the gripper handle attached between the cross strap and waist strap of the vest.

Attached to the vest 10 and positioned on each side of the operator 24 below the operator's arm pits are a pair of handles 46 and 48. As best shown in FIG. 4, each handle 46 and 48 preferably comprises an elongated, cylindrically shaped foam tube 50 having a small diameter passageway (not shown) extending therethrough. A strap 52 is forced into this passageway and through the passageway, permitting the strap's free ends to be attached, respectively, to side portions of the cross strap 16 and waist strap 18. The foam tube is preferably neoprene rubber or a cross-linked, closed cell foam made of a plastic such as polyurethane. Suitable foam tubes may be purchased from STL Distribution, Inc, of Seattle, Wash. or Grab-Bon, Inc. of Walla Walla, Wash.

The straps 12, 14, 16, 18 and 52 are all attached as illustrated using conventional box stitching. The straps 12, 14, 16, 18 and 52, handles 48 and 48 and webbing material 20 are all made of buoyant materials so that the vest 10 will float in water. The buckles 34, although they are heaver than water, do not prevent the vest 10 from floating. They are conventional and may be purchased from National Molding Corporation of Farmingdale, N.Y. under the Durflex trademark. The straps 12, 14, 16, 18 and 52 are preferably made of synthetic material such woven nylon or polypropylene filaments such as straps sold by John Howard Company, Inc. of Chino, Calif., one to two inch wide straps. The webbing material 20 is preferably made of non-absorbing synthetic material such woven nylon or polypropylene filaments. The webbing is purchased from Elizabeth Webbing Mills Company, Inc. of Central Falls, Rhode Island under the Unitex trademark.

Figure 3:
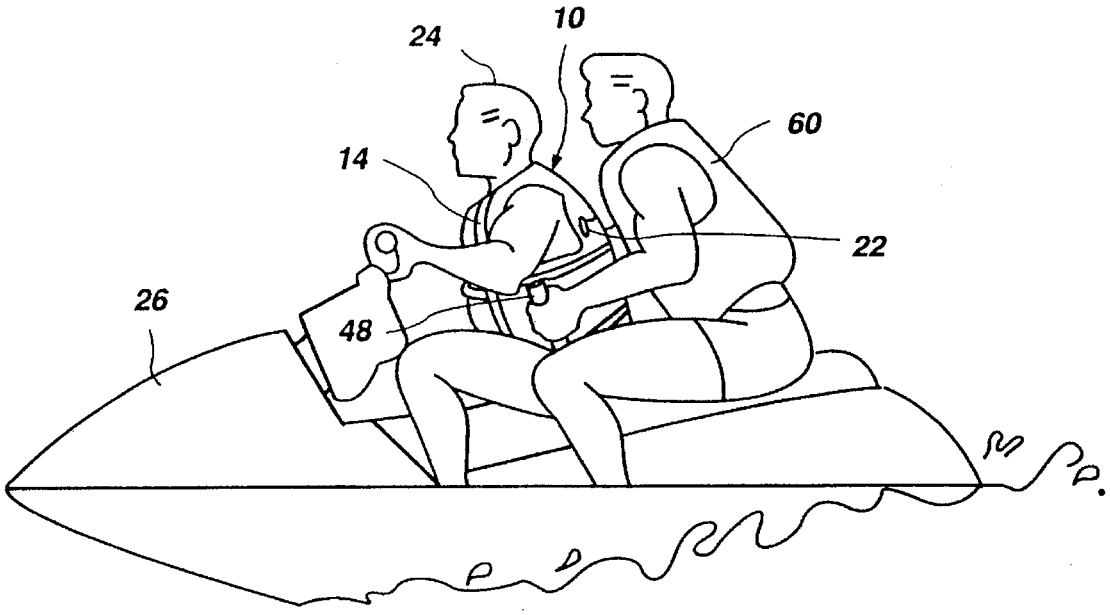
FIG. 3 is a side view showing two people riding a personal watercraft, the operator steering the watercraft wearing the vest of this invention and the rider holding on to the gripper handles of the vest.

As depicted in FIGS. 5 and 6, the operator 24 while wearing the life jacket 22 first unbuckles the buckles 34 to allow the operator's to put him or her arms between the shoulder straps 12 and 14 and the cross strap 16. The interlocking components of the buckles 34 are then connected together to secure the vest 10 over the life jacket 22. The operator 24 then mounts the personal watercraft 26 as depicted in FIG. 3, and the rider 60 then sits on the watercraft grasping the handles 46 and 48 firmly.

SCOPE OF THE INVENTION

The above presents a description of the best mode contemplated of carrying out the present invention, and of the manner and process of making and using it, in such full, clear, concise, and exact terms as to enable any operator skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

We claim:

1. A safety vest adapted to be worn by a forward rider of a pair of tandem vehicle riders, including a back section comprising a pair of shoulder straps positioned to fit over the shoulders of the forward rider, each shoulder strap having a front segment and a back segment extending lengthwise towards the waist of said forward rider, each segment having terminal ends near the waist of said forward rider while the vest is being worn, a cross strap attached to an intermediate portion of each of said front and back segments of the shoulder straps and positioned to be underneath and nearby the arm pits of the forward rider while the vest is being worn, said cross strap having free ends which terminate near the middle of the front upper torso of said forward rider while the vest is being worn, each free end having attached thereto one component of a first two-component buckle, so that said forward rider can manually buckle and unbuckle the first two-component buckle while the vest is being worn, a waist strap positioned below and spaced from the cross strap which is attached to the terminal ends of the front and back segments of the shoulder straps, said waist strap having free ends which terminate near the middle of the front upper torso near the waist of said forward rider while the vest is being worn, each free end having attached thereto one component of a second two-component buckle, so that the person can manually buckle and unbuckle the second two-component buckle while the vest is being worn, and a pair of handles, each handle having opposed ends, with one end attached to the cross strap and the other end attached to the waist strap, each handle being at one side of said forward rider while the vest is worn.

2. The safety vest of claim 1 where each handle comprises a tubular foam member with a connecting strap passing through said member and having terminal ends extending from the member which are respectively attached to the cross strap and waist strap.

3. The safety vest of claim 1 where there is a webbing material connected between back segments of the shoulder straps.

4. The safety vest of claim 1 where a portion of the cross strap extends between the back segments of the shoulder straps, and has opposed ends connected to the back segments, with said portion of the cross strap being free to serve as a handle.

5. A marine vest for a person riding a personal watercraft while wearing a life jacket, said life jacket having a front and a back, said marine vest including a back section comprising a pair of shoulder straps positioned to fit over the shoulders of the person while said person is wearing the life jacket, each shoulder strap having a front segment and a back segment extending lengthwise towards the waist of said person, respectively, over the life jacket's front and back, each segment having terminal ends near the waist of said person while the vest is being worn, a cross strap attached to an intermediate portion of each of said front and back segments of the shoulder straps and positioned to be underneath and nearby the arm pits of the person while the vest is being worn, said cross strap having free ends which terminate near the middle of the front upper torso of said person while the vest is being worn, each free end having attached thereto one component of a first two-component buckle, so that said person can manually buckle and unbuckle the first two-component buckle while the vest is being worn, a waist strap positioned below and spaced from the cross strap, said terminal ends of the front and back segments of the shoulder straps being attached to the waist strap, said waist strap having free ends which terminate near the middle of the front upper torso near the waist of said person while the vest is being worn, each free end having attached thereto one component of a second two-component buckle, so that the person can manually buckle and unbuckle the second two-component buckle while the vest is being worn, and a pair of handles, each handle having opposed ends, with one end attached to the cross strap and the other end attached to the waist strap, each handle being at one side of said person while the vest is worn, said vest being sized to fit over said life jacket and being primarily made of buoyant and non-water absorbing materials so that it will float in water.

6. The marine vest of claim 5 where each handle comprises a tubular foam member with a connecting strap passing through said member and having terminal ends extending from the member which are respectively attached to the cross strap and waist strap.

7. The marine vest of claim 6 where there is a webbing material connected between the back segments of the shoulder straps.

* * * * *